US007618278B2

(12) United States Patent
Bürk et al.

(10) Patent No.: US 7,618,278 B2
(45) Date of Patent: Nov. 17, 2009

(54) CLOSED HOUSING FOR A LOCKING ELEMENT OF A PLUG-IN CONNECTION

(75) Inventors: Thomas Bürk, Bad Liebenzell (DE); Gerald Schreiber, Rankweil (AT)

(73) Assignee: Hirschmann Automotive GmbH, Kweil/Bredris (AT)

( * ) Notice: Subject to any disclaimer, the term of this patent is extended or adjusted under 35 U.S.C. 154(b) by 0 days.

(21) Appl. No.: 11/791,010

(22) PCT Filed: Nov. 17, 2005

(86) PCT No.: PCT/EP2005/012318

§ 371 (c)(1), (2), (4) Date: May 17, 2007

(87) PCT Pub. No.: WO2006/053744

PCT Pub. Date: May 26, 2006

(65) Prior Publication Data

US 2008/0014781 A1 Jan. 17, 2008

(30) Foreign Application Priority Data

Jun. 29, 2005 (DE) ..... 10 2005 030 264

(51) Int. Cl.
*H01R 13/627* (2006.01)

(52) U.S. Cl. ..... 439/352; 439/489

(58) Field of Classification Search ..... 439/352, 439/489

See application file for complete search history.

(56) References Cited

U.S. PATENT DOCUMENTS

| | | | | |
|---|---|---|---|---|
| 5,605,472 | A * | 2/1997 | Sakai et al. | 439/489 |
| 5,681,178 | A | 10/1997 | Kunkle et al. | 439/489 |
| 6,022,238 | A | 2/2000 | Tomita et al. | 439/489 |
| 6,692,288 | B2 * | 2/2004 | Nimura | 439/352 |
| 6,716,052 | B2 * | 4/2004 | Kane | 439/352 |
| 6,736,675 | B2 * | 5/2004 | Kato et al. | 439/595 |

* cited by examiner

*Primary Examiner*—Hae Moon Hyeon
(74) *Attorney, Agent, or Firm*—Andrew Wilford

(57) ABSTRACT

A plug-in connection has a housing having a pair of spaced sides between which can fit a plug or socket. Each side is formed with an aperture with the apertures aligned transversely with each other. The housing further having a latch element and a locking element. A pair of spaced side walls are fixed to and project outward from one of the sides of the housing. The aperture of the one side of the housing is between the side walls, and the aperture on the other side of the housing is at least as large as the aperture of the one side. A cover bridges the side walls and forms therewith a recess adapted to receive the locking element movable therein. The cover and side walls at least almost completely enclose the latch element and locking element and are almost completely enclosed in an end region of the recess.

2 Claims, 6 Drawing Sheets

CLOSED HOUSING FOR A LOCKING ELEMENT OF A PLUG-IN CONNECTION

CROSS REFERENCE TO RELATED APPLICATIONS

This application is the US national phase of PCT application PCT/EP2005/012318, filed 17 Nov. 2005, published 26 May 2006 as WO 2006/053744, and claiming the priority of German patent application 102004005540 itself filed 17 Nov. 2004 and German patent application 102005030264.5 itself filed 29 Jun. 2005, whose entire disclosures are herewith incorporated by reference.

FIELD OF THE INVENTION

The invention relates to a locking device for a plug or a socket of a plug-in connection provided on a housing for the plug or the socket and comprising a latch element, optionally with or without a locking element, which may be placed in at least one locking position via a plug-in region.

BACKGROUND OF THE INVENTION

Plug-in connections are known from the prior art (for example, EP 0 655 807 A2, EP 0 854 546 B1 [U.S. Pat. No. 6,022,238], U.S. Pat. No. 5,803,651, DE 195 25 413 A1 [U.S. Pat. No. 5,605,472], DE 196 21 762 A1 [U.S. Pat. No. 5,681,178]) in which a plug and a socket may be joined together to form a plug-in connection. To prevent the plug-in connection from coming apart, locking devices are known which may be brought into at least one locking position after the plug and socket are joined so that the plug and socket cannot be separated during use of the plug-in connection, in particular for automotive applications. To ensure electrical contact for the plug-in connection, the locking device is particularly designed so that it cannot be brought into the locking position until the plug and socket have been completely joined. To ensure this, it is important that the locking device can be easily brought into the locking position. In the locking devices known from the prior art, optional locking elements are known which may be further displaced and which are provided on a housing for the plug or socket, that location being provided with a plug-in region for the locking element in which the locking element may be inserted to assume the locking position. The locking device in addition to the plug-in region and the optional overall system of the locking element on the housing for the plug or socket has the disadvantage that it is largely open, thus permitting contaminants (such as particles generated during the housing manufacturing process, or paints, when the housing for the plug or socket is provided with a coat of paint, or the like) to enter, with the disadvantageous result that the latch element for the locking device in addition to the optionally provided locking element either can no longer be inserted into the plug-in region, or, if it still functions at all, cannot be brought into its important locking position. As a result, the latch element cannot lock with the mating connector, or the locking element may, for example, fall out if it is placed in the plug-in region in a so-called prelocking position, or it may not be possible to completely lock the plug-in connection when the locking element is not in its at least one locking position (also referred to as the final locking position).

Finally, a locking device for a plug or a socket of a plug-in connection is known from DE 103 41 136 which properly performs the important locking function, the locking element designed as a sliding element being first brought into a prelocking position in the plug-in region after manufacture of the plug or socket, and not being moved into its final locking position until the plug and socket of the plug-in connection have been completely joined. Here as well, however, the locking element for the most part is open at the housing for the socket or the plug, thus allowing contaminant particles to penetrate. In addition, this locking element is designed in such a way that it produces an audible locking sound when it is brought from its prelocking position to its final locking position. In an open configuration of the locking element, however, this locking sound radiates into the surrounding space so that it is no longer perceivable, particularly when the movement of the locking element from its prelocking position to its final locking position takes place in a loud production room. Variants of this housing without these additional locking elements are also conceivable. In such variants, for housings for the plug or socket which are already provided with a coat of paint, the latch element may be fixed in such a way that complete joining of the socket and plug is not possible, or may be achieved only with great difficulty. Actuation of the latch element for unlocking such a problematic plug-in connection is then virtually impossible.

OBJECT OF THE INVENTION

The object of the invention, therefore, is to provide a locking device for a plug or a socket of a plug-in connection by means of which the plug and the socket of the plug-in connection are securely joined, and the above-described disadvantages are avoided, and optionally the possibility is provided for omitting additional locking elements.

SUMMARY OF THE INVENTION

The invention provides that the housing for the plug or the socket is designed such that the latch element, optionally with or without a locking element, in its locking position is completely or almost completely enclosed by a part of the housing. The part of the housing for the plug or the socket thus protects the latch element, optionally with or without a locking element, from external environmental conditions, in particular from contamination from loose particles or paint applications. Paint applications are used, for example, when the plug or the socket after being cabled has been installed on an add-on part (a motor, for example) of a vehicle, but has not yet been joined to form the complete plug-in connection. In other words, the plug, for example, after cabling and installation is first painted, and only then joined with the socket to form the overall plug-in connection. As a result of the almost complete encapsulation of the latch element, optionally with or without a locking element, in such a case paint cannot penetrate into the plug-in region, and therefore the latch element, with or without a locking element, may be brought into its locking position in a proper and operationally reliable manner when the plug and socket are joined together. A further advantage of the almost complete encapsulation of the latch element, optionally with or without a locking element, is that, as a result of the intentional design of the latch element, the locking sound produced upon reaching the locking position, in particular the final locking position, is more noticeable since it no longer radiates in an uncontrolled manner in the surrounding space, but instead is emitted in a concentrated manner through the plug-in region and/or some other small opening in the part of the housing, and is thus much more audible. This allows the additional locking element to be optionally omitted, since the satisfactory completion of the plug-in procedure is clearly audible. Economical plug-in connector designs and reduced handling costs may be achieved as a result. The necessity for using plug-in connections with an additional locking element is thus reduced to a few safety-related applications.

The locking device according to the present invention does not necessarily involve the design of the latch element, optionally with or without a locking element as such, or the means on the housing for the plug or socket which cooperates therewith. Thus, for example, the designs of the latch element, optionally with or without a locking element, known from the prior art may be used when just the locking element in its locking position is almost completely enclosed by the part of the housing. Use of the locking element known from DE 103 41 136 is particularly advantageous, since this locking element has numerous advantages. For one, it is easy to manufacture, and in particular the housing for the plug or the socket may be easily produced by injection molding. In addition, the known locking element is designed as a sliding element, and is inserted into the plug-in region and first fixed in a prelocking position. This process is generally carried out by the manufacturer of the plug or the socket, so the plug or socket prepared in this manner can be supplied on a cable assembly which provides the plug or the socket with contacts and cables. After this preparation, the cable bundle thus assembled may be delivered to an automobile manufacturer, for example, and installed. Since the installation, i.e. the joining of the plug and socket to form a plug-in connection, takes place on the automobile manufacturing assembly line, it is important to ensure that the plug and socket are completely joined in order to prevent malfunction of the plug-in connection. To this end, the appropriately prepared plug or socket offers the advantage that a locking sound is clearly audible during the plug-in procedure, which makes the use of an additional locking element only optional. In such cases, however, after the plug and socket are joined together the locking element is pushed into its final locking position, which according to the present invention is easily performed since, on account of the almost complete encapsulation, the motion of the locking element from the prelocking position to its final locking position is not hindered by contaminant particles, and the locking sound is clearly audible when the final locking position is reached.

BRIEF DESCRIPTION OF THE DRAWING

One illustrated embodiment of a socket (or alternatively, a plug) of a plug-in connection, to which the invention, however, is not limited, is described below and explained with reference to the figures in which.

SPECIFIC DESCRIPTION

Figure 1:
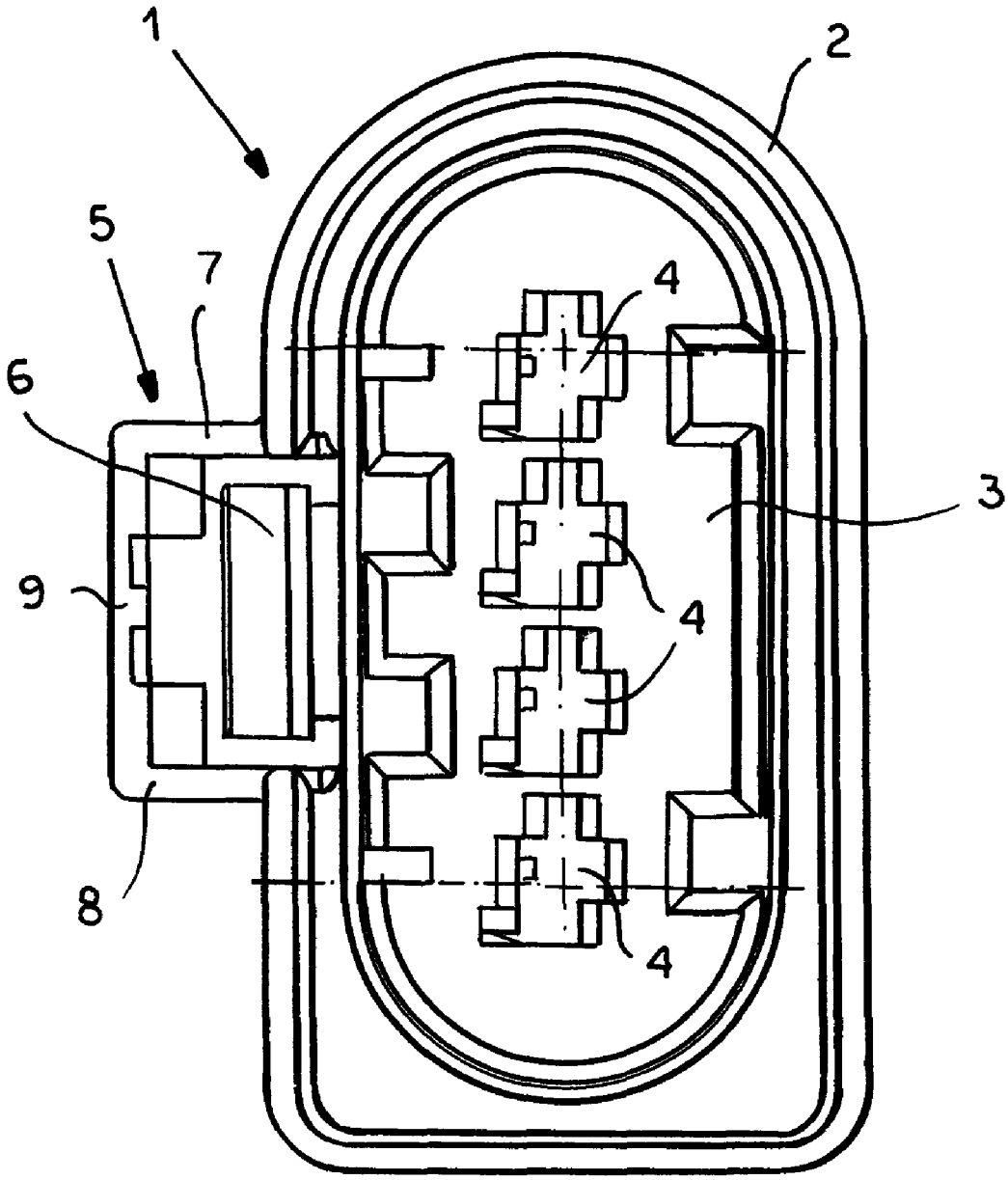
FIG. 1 shows an end face of a socket.

FIG. 1 shows in detail an end face of a socket 1 of a plug-in connection. Insofar as the description of the locking device according to the invention in the preceding or following discussion refers to a socket, the same applies for a plug. In addition, it is assumed that the locking device provided on the plug or the socket corresponds to analogous means provided on the plug or socket to be used.

The socket 1 has a housing 2 which accommodates an insert 3 having seats 4 for contacts (socket element), not illustrated here. The housing 2 and insert 3 are designed as separate components or as one piece. The seats 4 for the contacts are illustrated here in a single row, although more than four or less than four seats 4 may be provided. An application having two or more rows of sockets (plugs) is also possible.

On one side of the approximately rectangular housing 2 a locking device 5 is provided that has a design as known from DE 103 41 136 and described therein. The locking device 5 has a recess 6 in which a locking element (in the form of a sliding element, for example), not illustrated, is or may be inserted. In the region of the locking device 5 the housing 2 has side walls 7 and 8 which are connected by a continuous cover 9. The side walls 7 and 8 and cover 9 thus form a part of the housing 2 by means of which a latch element 18 (also see FIG. 6) as well as an optionally provided locking element (not illustrated) in its locking position are almost completely enclosed.

Figure 2:
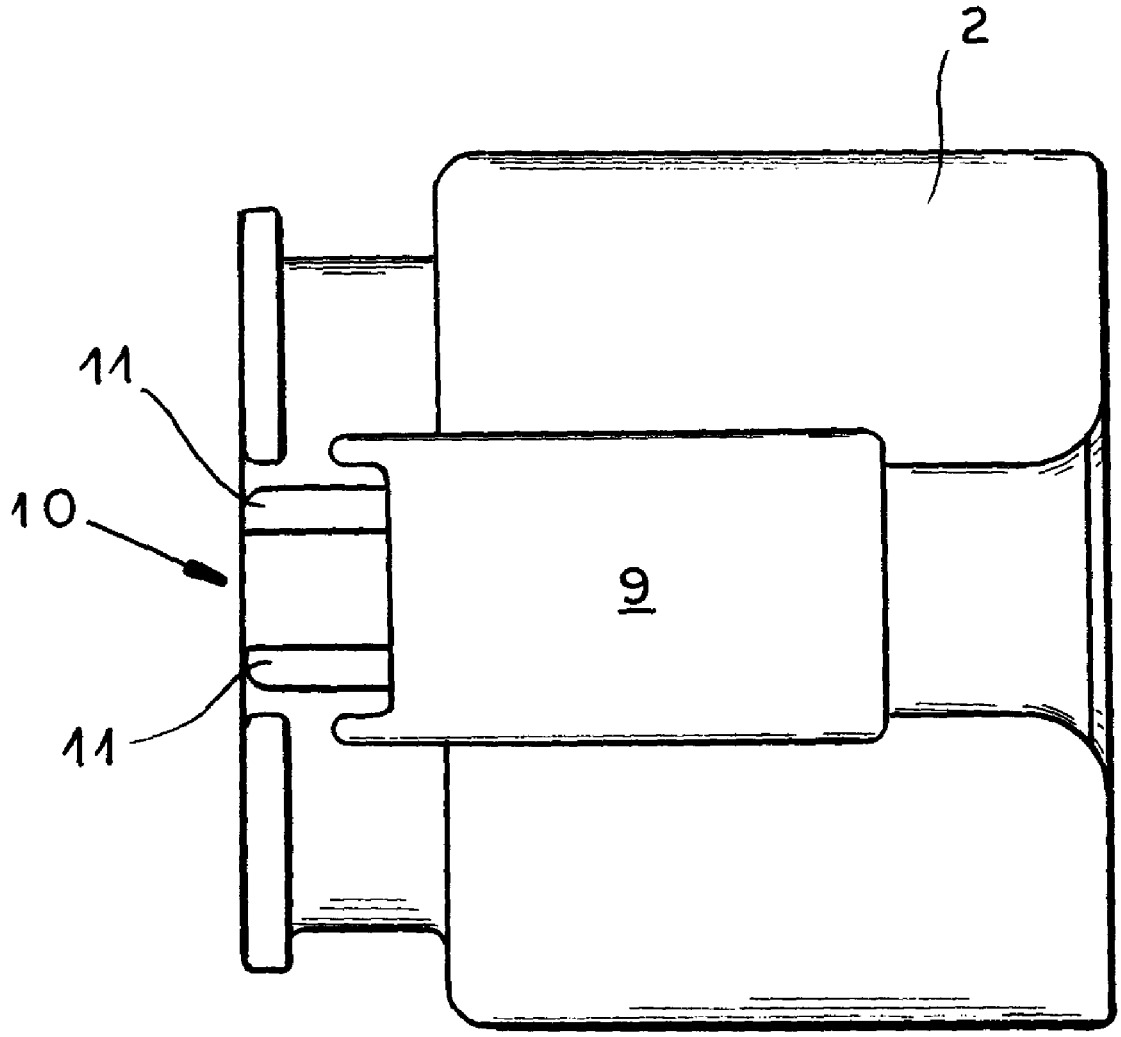
FIG. 2 shows a top view of the socket housing, with a view of the locking element located there.

The invention is further explained with reference to FIG. 2, which shows a top view of the housing 2 for the socket 1 with a view of the locking device 5 located there. It is seen that a plug-in region 10 for the locking element is provided on one side of the housing 2, and guide bars 11, for example, are provided as a guide for insertion of the locking element into the plug-in region 10 (and thus into the recess 6). Here as well, it is clear that the cover 9 almost completely encloses the recess 6 in which the latch element, optionally with or without a locking element, is subsequently provided. The housing 2 for the socket 1 may be manufactured in a particularly advantageous manner in a plastic injection-molding process, the outer surfaces of the housing 2 being formed by injection-molded halves, and the inner surfaces may be shaped by removable mold cores (casting tools).

Figure 3:
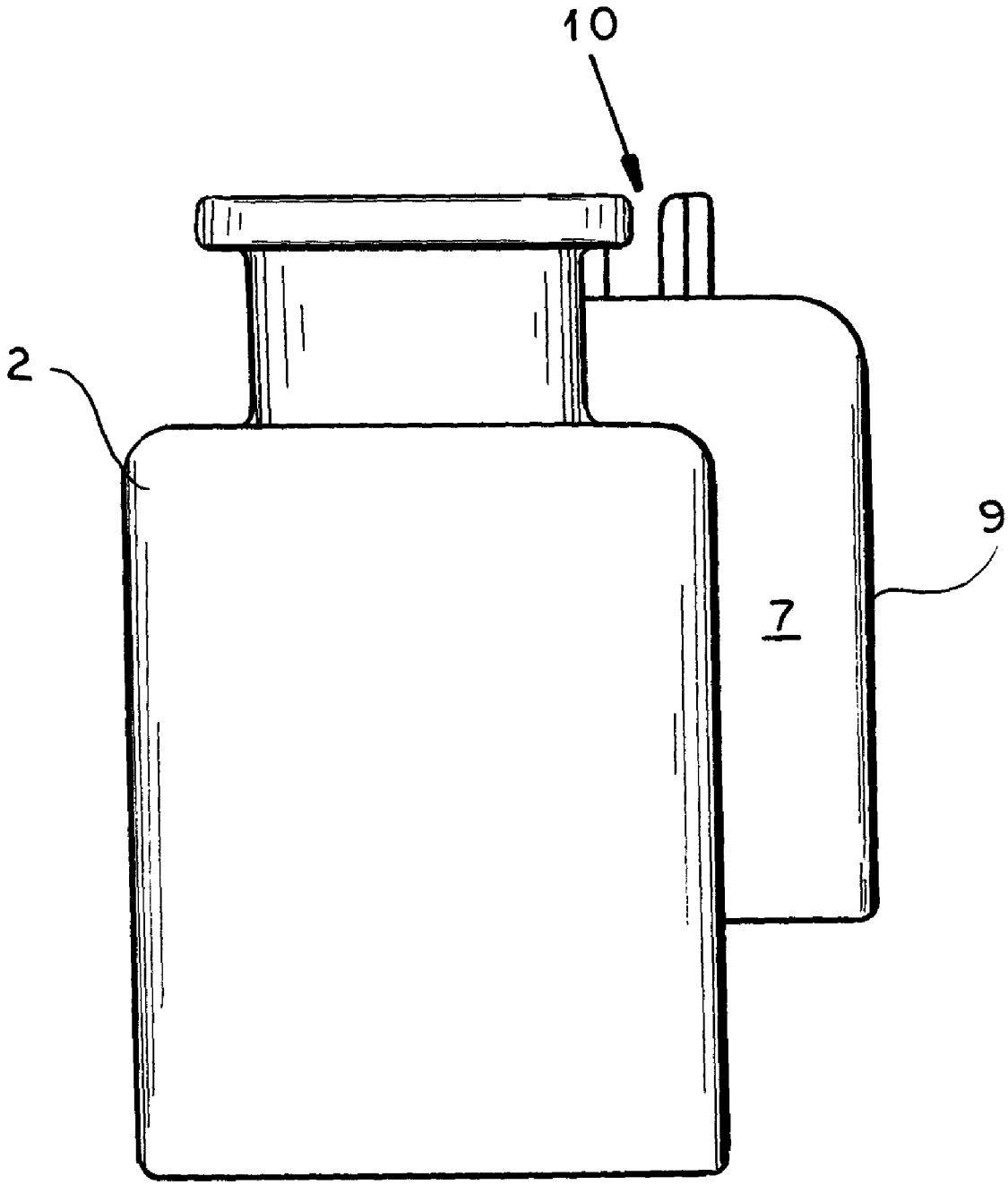
FIG. 3 shows a side view of the socket housing.

FIG. 3 illustrates a side view of the housing 2 for the socket 1, once again showing the side wall 7 (and the side wall 8, concealed) as well as the cover 9.

Figure 4:
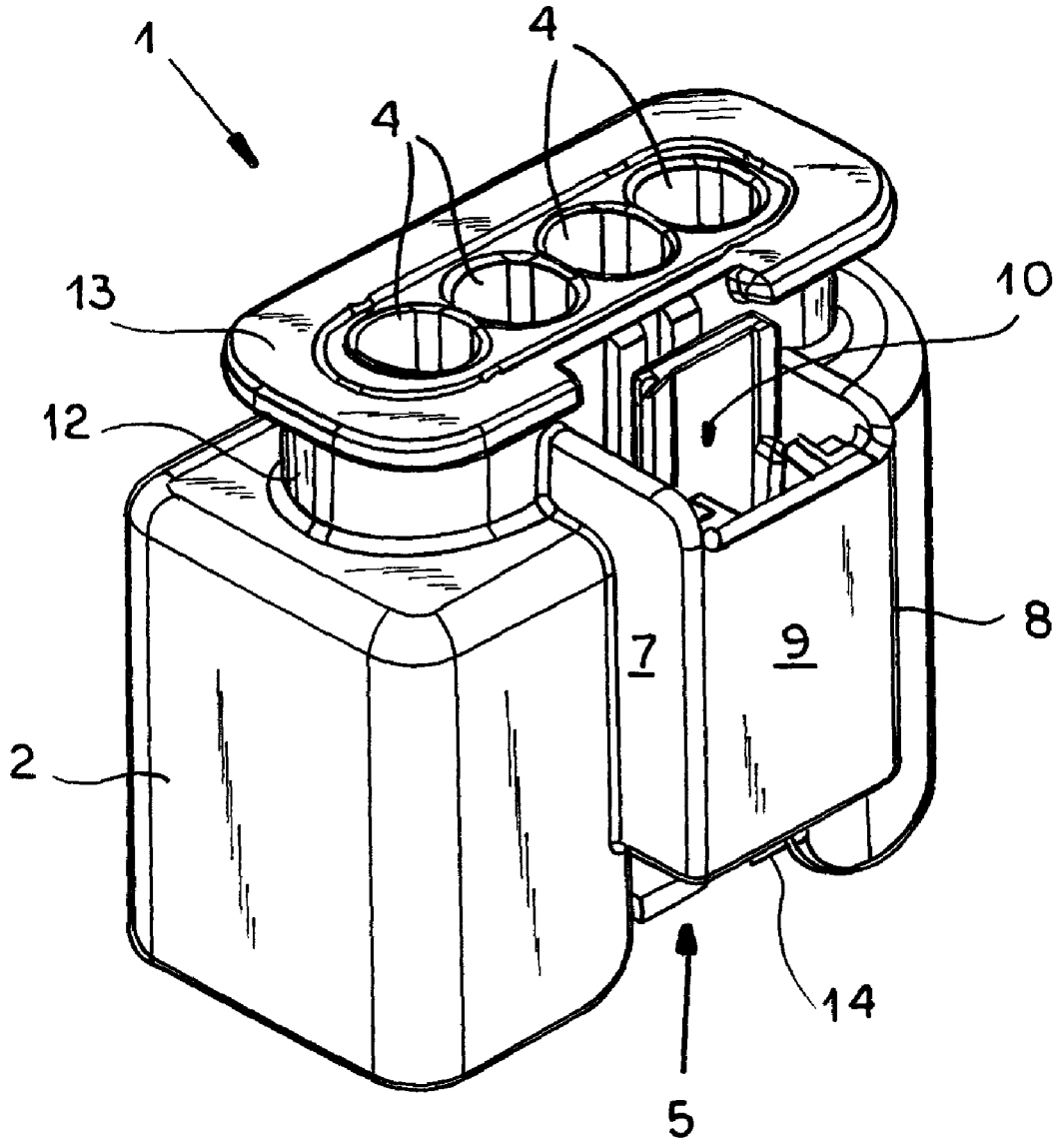
FIG. 4 shows a three-dimensional view of the socket housing with a view of the cable exit side.

FIG. 4 shows a three-dimensional view of the housing 2 for the socket 1 with a view of the cable exit side on which an annular collar 12 and an adjoining rim 13 are provided. Shown once again on one side of the housing 2 is the locking device 5 comprising the plug-in region 10, the side walls 7 and 8, and the cover 9. When the locking element (not illustrated here) is inserted into the plug-in region 10 the recess 6 is protected in advance from contaminants, and subsequently the locking element inserted at that location in its locking position is also protected from mechanical influences. It is particularly advantageous for a small part of the housing 2 which almost completely encloses the locking element to remain open during (and optionally also after) insertion, so that the locking sound is clearly audible when the locking element has reached its locking position (final locking position). For this purpose, at the end of the locking device 5 an end region 14 is provided which is open or which has a small opening. After the locking element is inserted, this end region 14, which is open or which has an opening, may be closed by an additional means or also by the locking element itself.

In the event that a locking element is not required, a variant is also possible having higher side walls 7 and 8 and a cover 9, so that the latch element 18 is better protected. In this manner the advantages with respect to the above-mentioned risk of contamination and damage are further enhanced.

Figure 5:
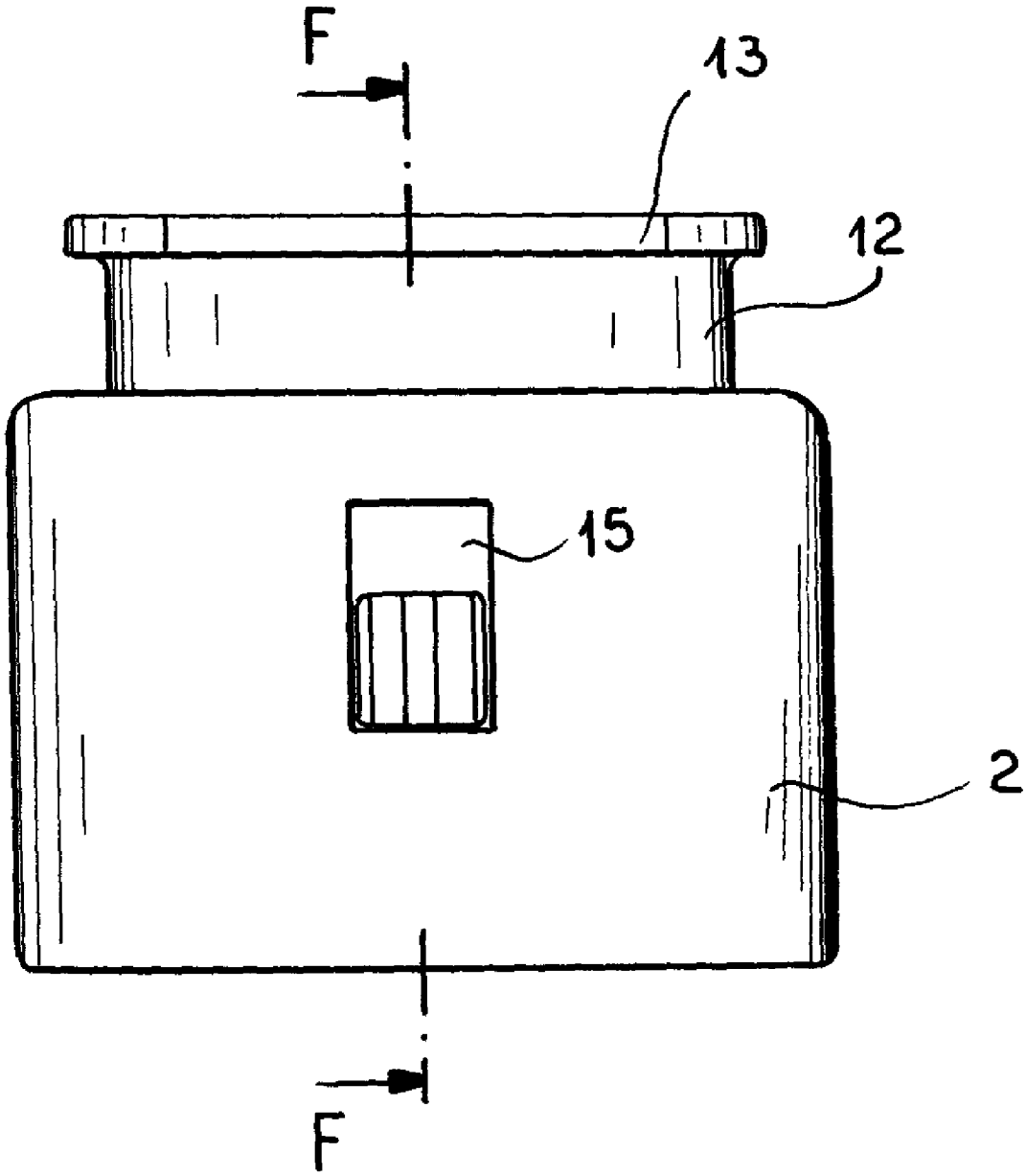
FIG. 5 shows a bottom view of the socket housing with a view of the side opposite from the locking element.

FIG. 5 shows a top view of the housing 2 for the socket 1 on the side opposite the locking element 5. The housing 2 is seen to have an aperture 15 that is necessary for guiding a die part through during injection molding of the housing 2, in order to produce the shape of the aperture 16 in the locking device 5. This is because this aperture 16 is no longer accessible to the die part since the cover 9 must likewise be produced by injection molding. Optionally, a design without the aperture 15 is also possible when use is made of the corresponding tool engineering possibilities. If the aperture 15 is provided, consideration may be given to closing this aperture afterward, if necessary.

Figure 6:
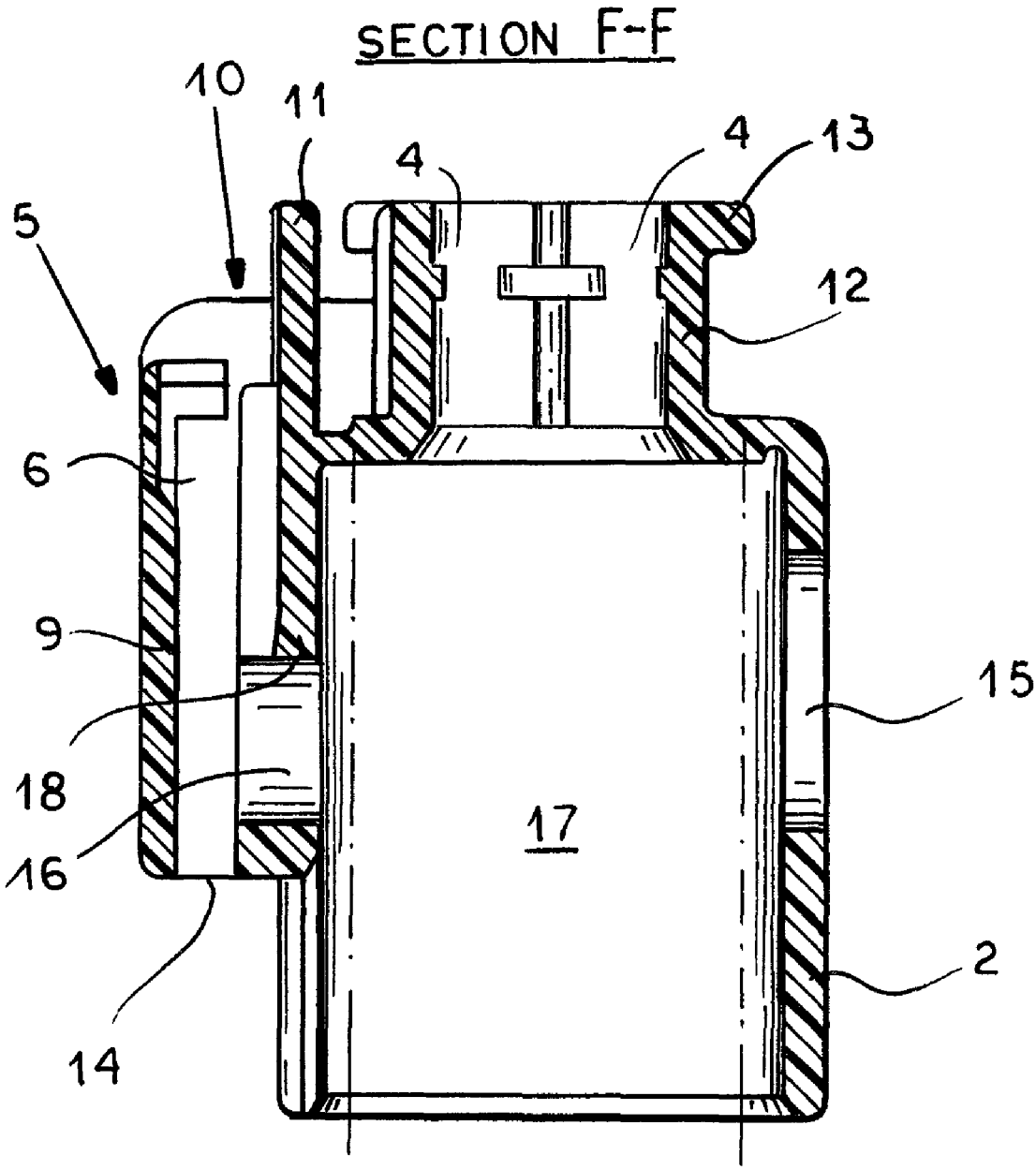
FIG. 6 shows a section F-F of the socket housing according to FIG. 5.

FIG. 6 shows a section F-F of the housing 2 for the socket 1 according to FIG. 5. In addition to the elements shown in the previous figures and provided with identical reference numerals, FIG. 6 shows at 16 the additional aperture, located approximately opposite the aperture 15, and reference numeral 17 denotes a seat for a plug for the socket illustrated here. The aperture 16 is necessary so that, for example, a locking hook (not illustrated) for the plug inserted into the seat 17 may engage in the aperture in order to accommodate the latch element 18 (the edge of the aperture 16 or an additional part, for example), which is initially in a starting position, so that the latch element can be brought from this starting position into its final locking position by pushing it into the socket 1. It is shown here that the end region 14 of the locking device 5 is open so that the locking sound upon reaching the final locking position is concentrated and therefore clearly audible. It is also shown once again that the housing 2 and the additional cover 9 almost completely enclose the latch element and the optionally provided locking elements which are located in the recess 6. It is advantageous for the housing 2 to have the aperture 16 on the side on which the locking device 5 is provided, and for the aperture 15 which is at least the same size or larger, to be provided on approximately the opposite side so that a mold part of simple design may be guided through the apertures 15 and 16 during manufacture of the housing 2 in order to shape, at least partially, the inner surface of the recess 6. In the event that the cover 9 is not manufactured in one work step during the injection molding of the housing 2, but instead is attached later, the cover may be made by various joining methods, in which case the aperture 15 may be omitted.

It is also possible to make the aperture 16 by use of appropriate tool engineering measures without the need for the aperture 15.

The invention claimed is:

1. A plug-in connection comprising:

a housing having a pair of spaced sides between which can fit a plug or socket, each side being formed with an aperture with the apertures aligned transversely with each other, the housing further having a latch element and a locking element;

a pair of spaced side walls fixed to and projecting outward from one of the sides of the housing, the aperture of the one side of the housing being between the side walls, the aperture on the other side of the housing being at least as large as the aperture of the one side; and a cover bridging the side walls and forming therewith a recess adapted to receive the locking element movable therein, the cover and side walls at least almost completely enclosing the latch element and locking element and being almost completely enclosed in an end region of the recess.

2. The plug-in connection according to claim 1 wherein the latch element is provided in the recess and corresponds to the locking element in order to fix the locking element in the recess.

* * * * *